US010779068B1

(12) United States Patent
Williams, Sr.

(10) Patent No.: US 10,779,068 B1
(45) Date of Patent: Sep. 15, 2020

(54) MICROPHONE

(71) Applicant: Andrew Williams, Sr., Roosevelt, NY (US)

(72) Inventor: Andrew Williams, Sr., Roosevelt, NY (US)

( * ) Notice: Subject to any disclaimer, the term of this patent is extended or adjusted under 35 U.S.C. 154(b) by 35 days.

(21) Appl. No.: 16/105,515

(22) Filed: Aug. 20, 2018

Related U.S. Application Data

(60) Provisional application No. 62/547,224, filed on Aug. 18, 2017.

(51) Int. Cl.
*H04R 1/00* (2006.01)
*H04R 1/08* (2006.01)
*H04R 1/04* (2006.01)

(52) U.S. Cl.
CPC ..... *H04R 1/083* (2013.01); *H04R 1/04* (2013.01); *H04R 2420/07* (2013.01)

(58) Field of Classification Search
CPC ..... H04R 1/08; H04R 1/083; H04R 1/086
See application file for complete search history.

(56) References Cited

U.S. PATENT DOCUMENTS

D213,051 S 12/1968 Herrold, III
D230,990 S 3/1974 Kollesberger, Jr.
D271,937 S 12/1983 Combs
D310,368 S 9/1990 Derhaag
D362,588 S 9/1995 Cohen
5,706,359 A 1/1998 Chang
D401,963 S 12/1998 Schneider
D424,775 S 5/2000 Rabinowitz
6,061,457 A 5/2000 Stockhamer
D433,910 S 11/2000 Oliver
D462,343 S 9/2002 Wang
D475,699 S 6/2003 Thornton
D479,836 S 9/2003 Thornton
6,671,382 B2 12/2003 Chen
D504,678 S 5/2005 Ruhrig
D508,720 S 8/2005 Yuen
D533,761 S 12/2006 Lin
7,155,024 B2 12/2006 Chang
D549,209 S 8/2007 Bauman
D557,690 S 12/2007 Lee
D575,771 S 8/2008 Tolve
D585,434 S 1/2009 Ganley
D587,250 S 2/2009 Cai
2012/0014552 A1* 1/2012 Yang ..... H04R 1/02 381/361

* cited by examiner

*Primary Examiner* — Matthew A Eason
(74) *Attorney, Agent, or Firm* — Allen Dyer Doppelt & Gilchrist, PA

(57) ABSTRACT

A microphone includes finger grips extending at least partially around a circumference of the microphone head and/or handle to improve a performer's grip thereon during use. A transducer is located and oriented within the head to improve reception based on grip location.

18 Claims, 4 Drawing Sheets

MICROPHONE

CROSS-REFERENCE TO RELATED APPLICATION

This application claims the benefit of U.S. Provisional Patent Application No. 62/547,224, filed on Aug. 18, 2017, the contents of which are herein incorporated by reference in their entirety.

FIELD OF THE INVENTION

The present invention relates to microphones, and more particularly to handheld microphones.

BACKGROUND OF THE INVENTION

When voice amplification and/or recording is required or desired, many individuals use handheld microphones—either wired or wireless—for this purpose. For instance, many musicians will employ a handheld microphone during performances. A typical handheld microphone employs an elongated handle with a microphone head located at one end thereof. The voice is directed into the head, which often is somewhat bulbous relative to the handle, and features a wire mesh or other porous cover to facilitate the passage of sound through the head to the transducer. The transducer is typically located inside the head, often proximate the junction with the handle.

Many performers will, either initially or during the course of a performance, hold the microphone such that one or more fingers are located on the head, versus the handle. While this manner of holding a microphone is preferred for many performers, and has been widely known for decades, microphone interior and exterior configurations still tend to reflect the assumption that the microphone will be held exclusively by the handle. Thus, further improvements are possible.

SUMMARY OF THE INVENTION

In view of the foregoing, it is an object of the present invention to provide an improved microphone.

According to an embodiment of the present invention, a microphone comprises a handle extending along a handle axis between a first handle end and second handle end, and a head connected to the first handle end and extending away therefrom along the handle axis. At least a first finger grip is formed in the head extending at least partially around a circumference thereof.

According to an aspect of the invention, the microphone further comprises a transducer having a reception axis and located within the head, the transducer being positioned such that the reception axis is offset from the handle axis.

According to another aspect of the invention, a second finger grip is formed in the head, a second arc of the second finger grip lying in a second plane intersecting the handle axis separated by an angle from the first plane, the reception axis lying within the angle between the first and second planes.

According to a further aspect, an angle between distally-oriented faces of the first and second planes is less than 180 degrees, and more preferably between approximately 120 and 160 degrees.

According to another embodiment of the present invention a microphone comprises a handle extending along a handle axis between a first handle end and second handle end, and a head connected to the first handle end and extending away therefrom along the handle axis. At least one first finger grip is formed in at least one of the handle and head extending at least partially around a circumference thereof. According to an aspect of the invention, the at least one finger grip is formed in the handle.

These and other objects, aspects and advantages of the present invention will be better appreciated in view of the drawings and following detailed description of preferred embodiments.

DETAILED DESCRIPTION OF PREFERRED EMBODIMENTS

Figure 1:
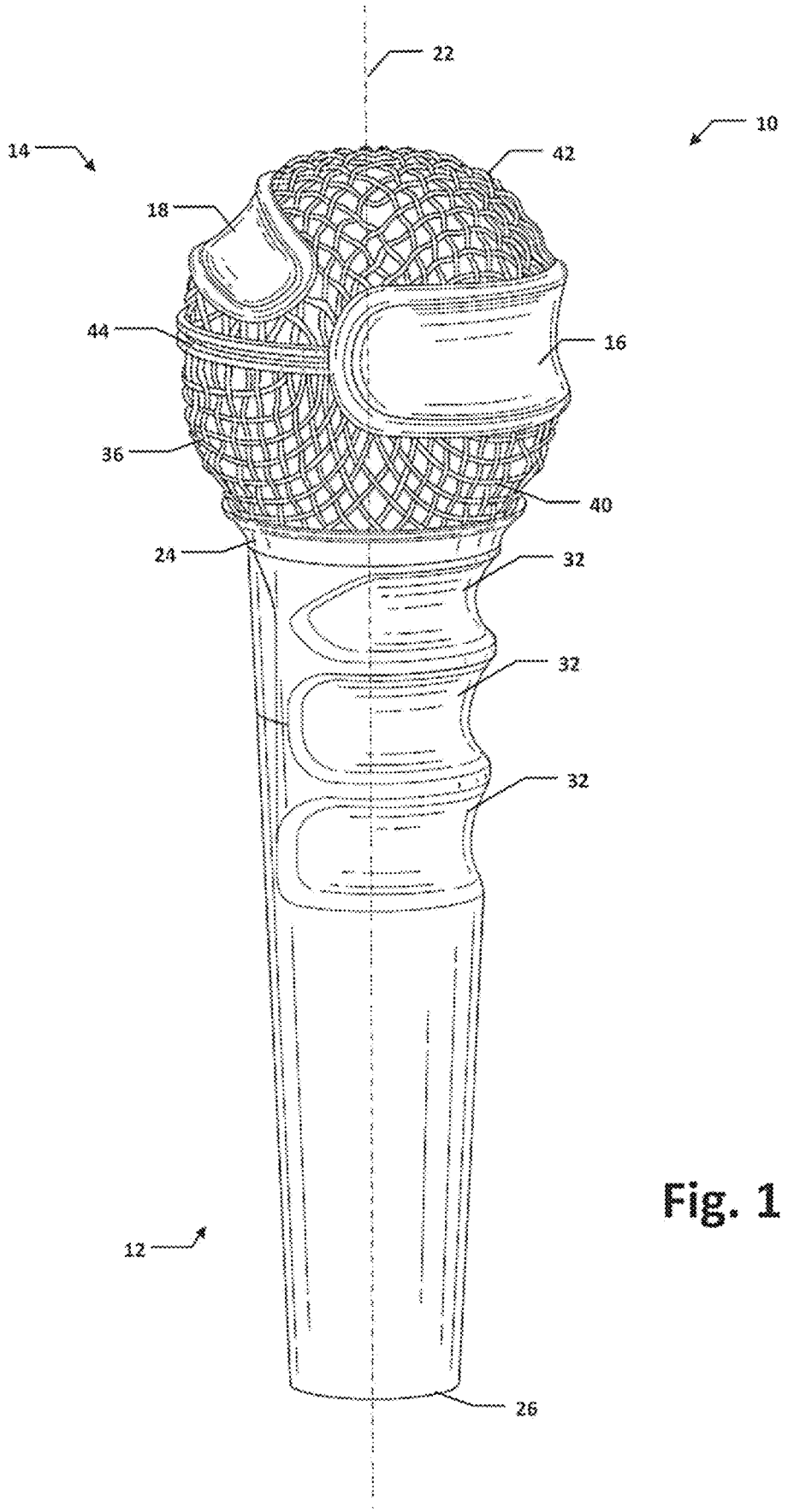
FIG. 1 is a perspective view of a microphone, according to an embodiment of the present invention.
Figure 2:
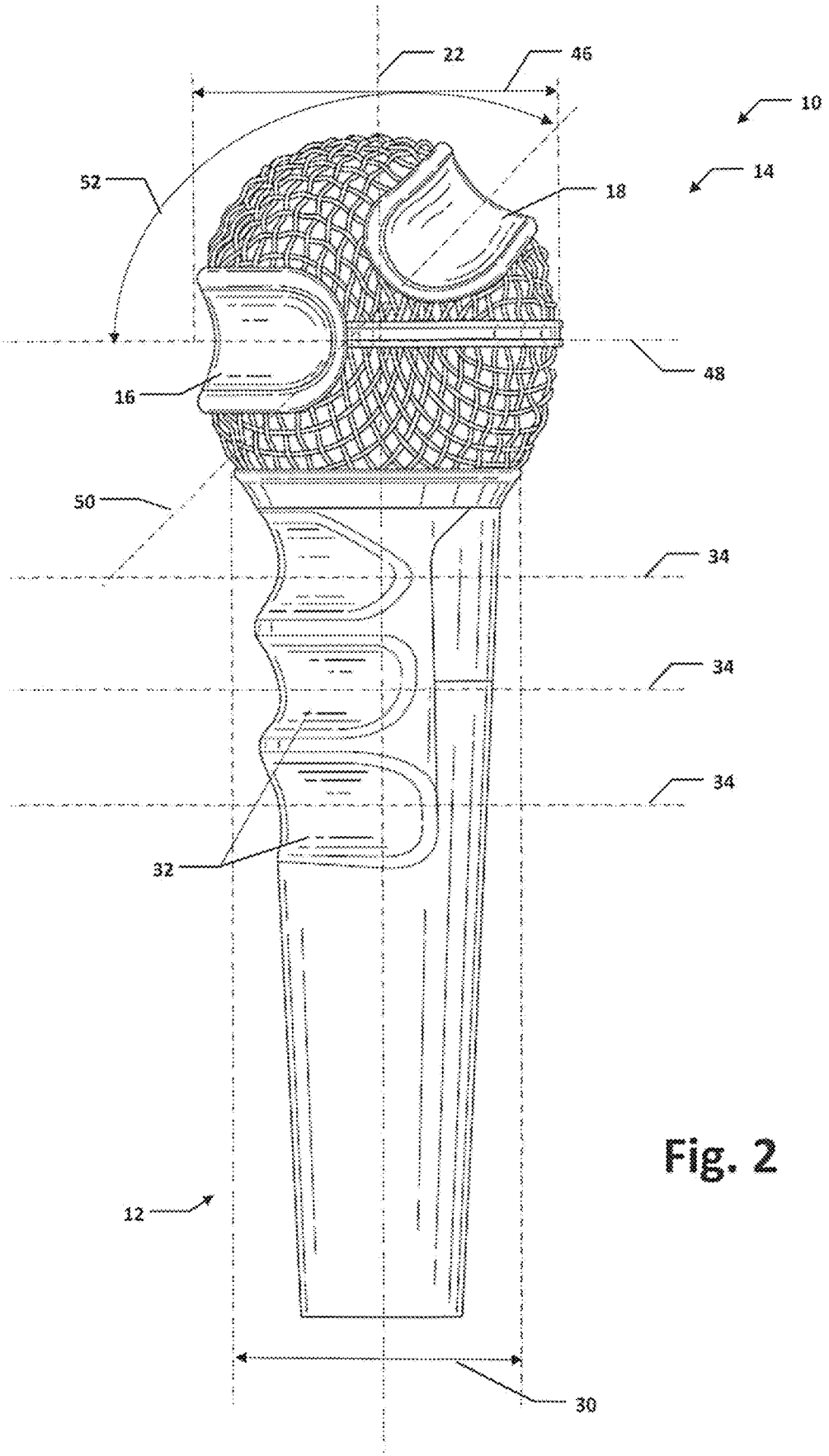
FIG. 2 is a side view of the microphone of FIG. 1.
Figure 3:
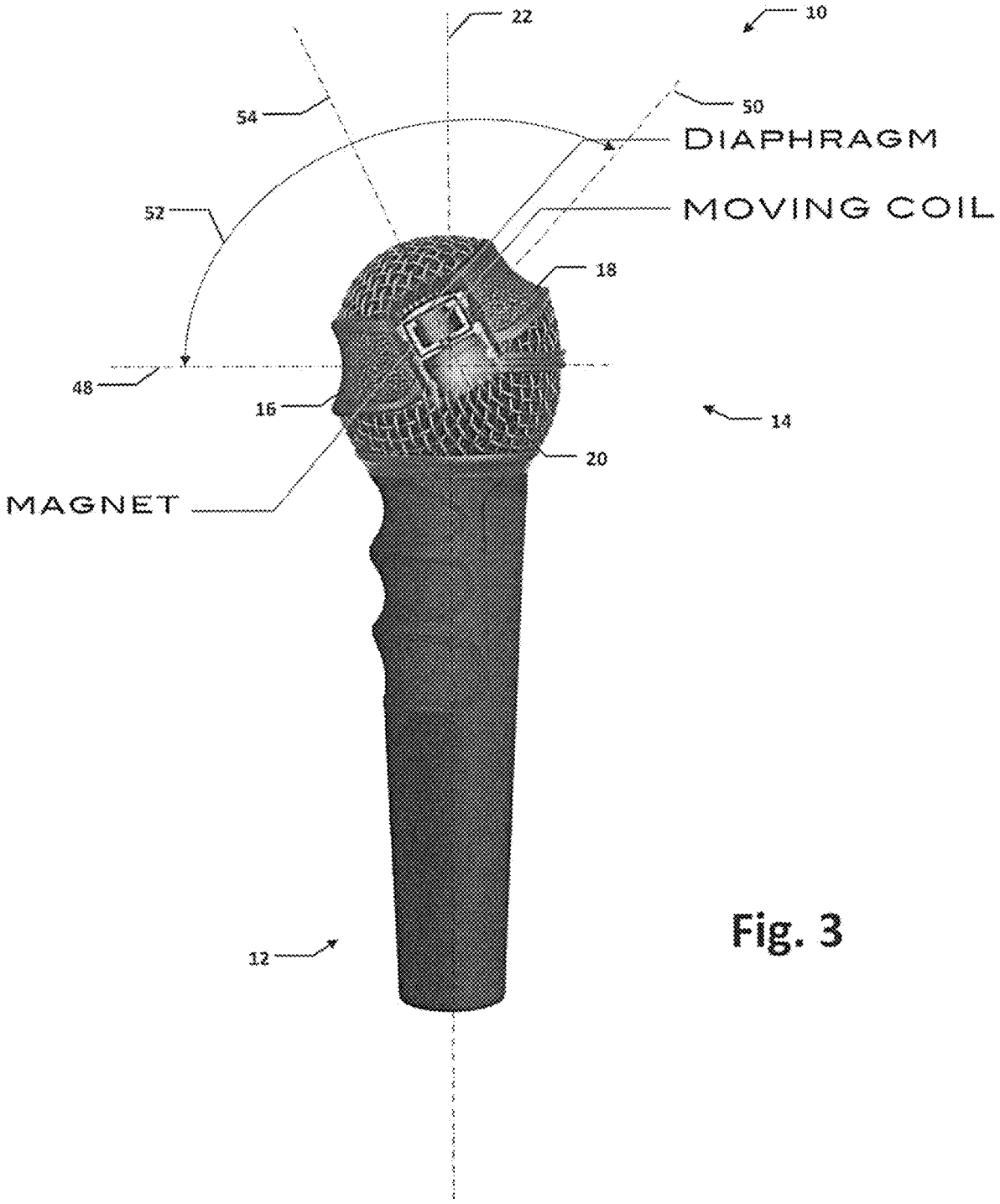
FIG. 3 is a partially cutaway side view of the microphone of FIG. 1.

According to an embodiment of the present invention, referring to FIGS. 1 and 2, a microphone 10 includes a handle 12 and a head 14. A plurality of head finger grips 16, 18 are formed on the head 14 to facilitate the gripping thereof. Referring to FIG. 3, a transducer 20 located within the head 14 is positioned so as enhance sound reception with the microphone 10 grasped by the head finger grips 16, 18.

The handle 12 extends along a handle axis 22 between a first end 24, to which the head 14 is attached, and a second end 26. In the depicted embodiment, the handle 12 is generally cylindrical about the handle axis 22, with a gradual taper from a maximum handle diameter 30 at the first end 24 to a smaller diameter at the second end 26. Alternately, other handle shapes/profiles could be employed in connection with the present invention.

A plurality of handle finger grips 32 are formed in the handle extending at least partially around the handle axis 22. In the depicted embodiment, three (3) finger grips 32 are formed, each extending circumferentially at least 50% around the handle axis 22. An arc of each grip 30 lies in a plane 34 approximately perpendicular to the handle axis 22.

A majority of the microphone head 14 is preferably covered in a porous material 36, such as a wire mesh. The head 14 extends away from the first end 24 of the handle 12 along the handle axis 22, with a proximal portion 40 closer to the handle 12 and a distal portion 42 more distant from the handle 12. In the depicted embodiment, there is a visible divider 44 between the proximal and distal portions 40, 42—although no visible divider is required. Also in the depicted embodiment, the head 14 is bulbous relative to the handle 12, having a maximum diameter 46 greater than a maximum handle diameter. However, it will be understood that other head shapes/profiles could be employed in connection with the present invention.

In the depicted embodiment, the plurality of head finger grips 16, 18 include a first finger grip 16, whose arc lies in a plane 48 approximately perpendicular to the handle axis 22 (similarly to the handle finger grips 32), and a second finger grip 18, whose arc lies in a plane 50 intersecting the handle axis 22 at an acute angle. Preferably, an angle 52 between distally-oriented faces of the planes 48, 50 is less than 180 degrees, and more preferably between approximately 120 and 160 degrees.

Each of the head finger grips 16, 18 is preferably on an opposite side of the handle axis 22, with the circumferential extent of each grip 16, 18 preferably extending less than 50% around of the handle axis. The first finger grip 16 is preferably located on the same side of the handle axis 22 as the handle finger grips 32, with the second finger grip 18 being on the opposite side thereof. Additionally, the first finger grip 16 preferably bridges the proximal and distal portions 40, 42, while second finger grip 18 is located entirely within the distal portion 42.

The transducer 20 is located within the head 14. While virtually all transducers are at least multi-directional to some degree, the physical configuration of most transducers allows the identification of a reception axis 54, in the general direction of which the transducer 20 is best suited to receive sound. The transducer 20 is advantageously positioned such that the reception axis is offset from the handle axis 22. Preferably, the reception axis 54 lies within the angle 52 between the distally-oriented faces of the planes 48, 50, and more preferably approximately bisects the angle 52.

Additionally, rather than being positioned proximate the first end 24 of the handle, the transducer 20 is preferably located between the proximal and distal portions 40, 42 of the head 14. Most preferably, the transducer 20 is located proximate the intersection between the plane 46 and the handle axis 22.

The present invention is not limited to any particular type of microphone transducer. For example, the present invention could be employed in connection with the both dynamic and condenser microphones. Additionally, the present invention could be employed in connection with both wired and wireless microphones, and where employed with wireless microphones, any wireless connection standard could be used (e.g., Bluetooth, Wi-Fi, etc.).

Figure 4:
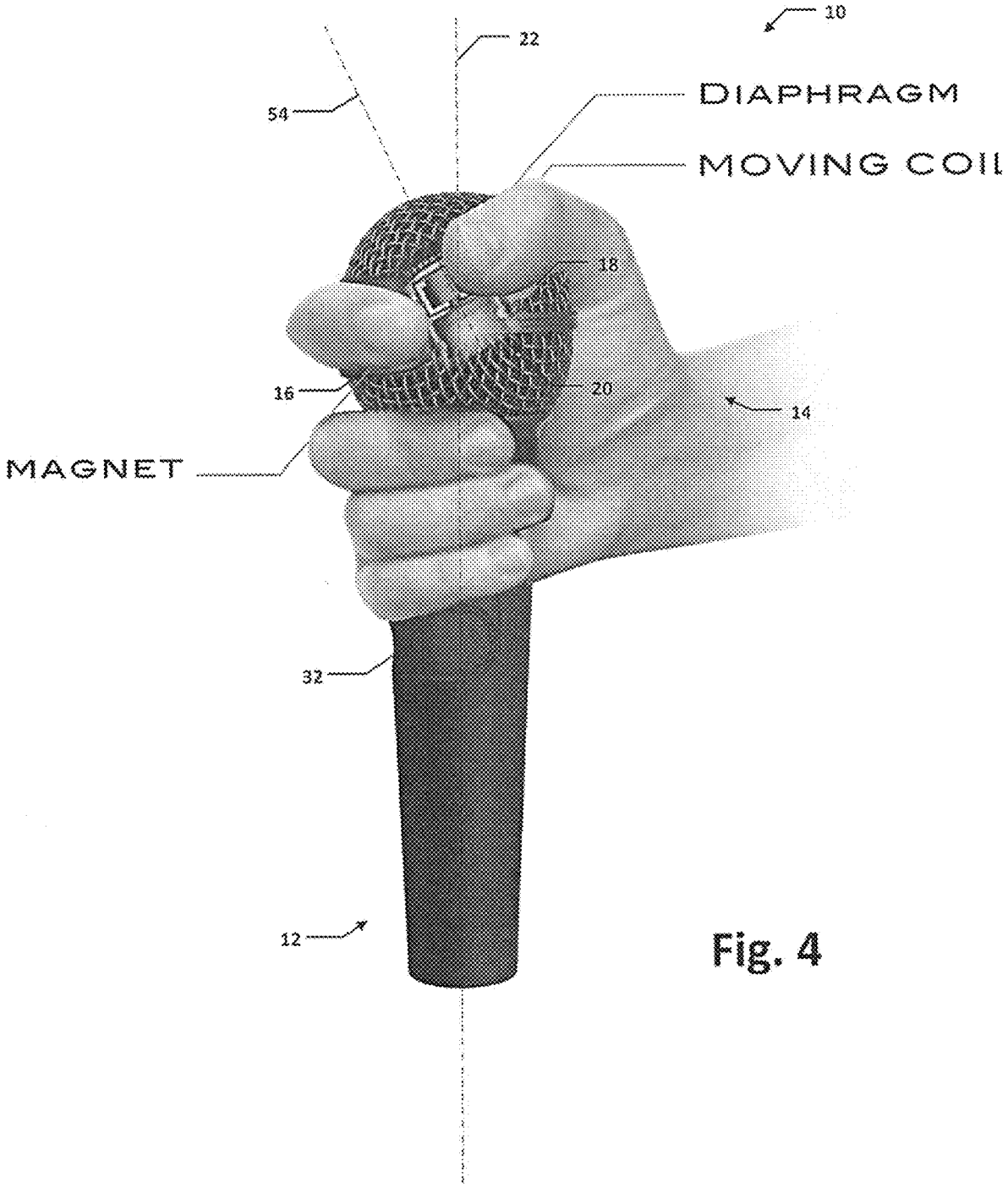
FIG. 4 is a partially cutaway side view of the microphone of FIG. 1, being grasped in the hand of a user.

In use, a user grasps the microphone 10, utilizing the head and handle finger grips 16, 18, 32 in a manner similar to that shown in FIG. 4. As will be appreciated, not only is the grip on the microphone 10 enhanced, but the transducer 20 positioning ensures improved sound reception due to the absence of hand/finger interference with the reception axis 54.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A microphone comprising:

a handle extending along a handle axis between a first handle end and second handle end; and a head connected to the first handle end and extending away therefrom along the handle axis, at least a first finger grip being formed in the head extending at least partially around a circumference thereof; and a transducer having a reception axis and located within the head, the transducer being positioned such that the reception axis is offset from the handle axis.

2. The microphone of claim 1, wherein a first arc of the first finger grip lies in a first plane intersecting the handle axis, the reception axis also being offset from the first plane.

3. The microphone of claim 2, wherein a second finger grip is formed in the head, a second arc of the second finger grip lying in a second plane intersecting the handle axis separated by an angle from the first plane, the reception axis lying within the angle between the first and second planes.

4. The microphone of claim 3, wherein the reception axis approximately bisects the angle between the first and second planes.

5. The microphone of claim 1, wherein a first arc of the first finger grip lies in a first plane, and a second finger grip is formed in the head having a second arc lying in a second plane different than the first plane.

6. The microphone of claim 5, wherein an angle between distally-oriented faces of the first and second planes is less than 180 degrees.

7. The microphone of claim 6, wherein the angle between the distally-oriented faces of the first and second planes is between approximately 120 and 160 degrees.

8. The microphone of claim 7, wherein the first plane is approximately perpendicular to the handle axis and the second plane intersects the handle axis such that the distally-oriented face of the second plane is at an acute angle to the handle axis.

9. The microphone of claim 6, wherein a circumferential extent of each of the first and second finger grips extends less than 50% around the handle axis.

10. The microphone of claim 9, wherein the first and second finger grips are located on opposite sides of the handle axis.

11. The microphone of claim 9, wherein at least one handle finger grip is formed in extending partially around the handle, the first finger grip and a majority of the at least one handle finger grip being located on a same side of the handle axis.

12. The microphone of claim 6, wherein the head is divided into a proximal portion closer to the handle and distal portion more distant from the handle and a visible divider is located between the proximal and distal portions.

13. The microphone of claim 12, wherein the first finger grip bridges the proximal and distal portions.

14. The microphone of claim 13, wherein the second finger grip is located entirely within the distal portion.

15. The microphone of claim 1, wherein the head is bulbous relative to the handle, a maximum head diameter being greater than a maximum handle diameter.

16. A microphone comprising:

a handle extending along a handle axis between a first handle end and second handle end; and a head connected to the first handle end and extending away therefrom along the handle axis, at least a first finger grip being formed in the head extending at least partially around a circumference thereof;

wherein a first arc of the first finger grip lies in a first plane, and a second finger grip is formed in the head having a second arc lying in a second plane different than the first plane;

wherein an angle between distally-oriented faces of the first and second planes is between approximately 120 and 160 degrees; and wherein the first plane is approximately perpendicular to the handle axis and the second plane intersects the handle axis such that the distally-oriented face of the second plane is at an acute angle to the handle axis.

17. A microphone comprising:

a handle extending along a handle axis between a first handle end and second handle end; and a head connected to the first handle end and extending away therefrom along the handle axis, at least a first finger grip being formed in the head extending at least partially around a circumference thereof;

wherein a first arc of the first finger grip lies in a first plane, and a second finger grip is formed in the head having a second arc lying in a second plane different than the first plane;

wherein an angle between distally-oriented faces of the first and second planes is less than 180 degrees;

wherein a circumferential extent of each of the first and second finger grips extends less than 50% around the handle axis; and wherein at least one handle finger grip is formed in extending partially around the handle, the first finger grip and a majority of the at least one handle finger grip being located on a same side of the handle axis.

18. A microphone comprising:

a handle extending along a handle axis between a first handle end and second handle end; and a head connected to the first handle end and extending away therefrom along the handle axis, at least a first finger grip being formed in the head extending at least partially around a circumference thereof;

wherein a first arc of the first finger grip lies in a first plane, and a second finger grip is formed in the head having a second arc lying in a second plane different than the first plane;

wherein an angle between distally-oriented faces of the first and second planes is less than 180 degrees;

wherein the head is divided into a proximal portion closer to the handle and distal portion more distant from the handle and a visible divider is located between the proximal and distal portions;

wherein the first finger grip bridges the proximal and distal portions; and wherein the second finger grip is located entirely within the distal portion.

* * * * *